US006772472B2

(12) United States Patent
Wang

(10) Patent No.: US 6,772,472 B2
(45) Date of Patent: Aug. 10, 2004

(54) ERASER HAVING SELECTIVELY OPENABLE AND CLOSABLE APERATURES

(76) Inventor: Yu Long Wang, 1102 6th Building 2nd District, An Zhen Xi Li Beijing (CN), 100029

( * ) Notice: Subject to any disclaimer, the term of this patent is extended or adjusted under 35 U.S.C. 154(b) by 236 days.

(21) Appl. No.: 10/119,265

(22) Filed: Apr. 9, 2002

(65) Prior Publication Data

US 2003/0000042 A1 Jan. 2, 2003

(51) Int. Cl.[7] ..... A47L 5/24
(52) U.S. Cl. ..... 15/344; 15/403
(58) Field of Search ..... 15/344, 363, 380, 15/393, 403; D19/53

(56) References Cited

U.S. PATENT DOCUMENTS

| | | | | |
|---|---|---|---|---|
| 1,801,620 | A | 4/1931 | Bettman | |
| 3,066,345 | A | 12/1962 | Kasper | |
| 4,204,298 | A | 5/1980 | Handa et al. | |
| 4,742,594 | A | 5/1988 | Chen | |
| 4,941,225 | A | 7/1990 | Liao | |
| 5,216,776 | A | 6/1993 | Dennison | |
| D366,670 | S | 1/1996 | Huh | |
| 5,537,711 | A | 7/1996 | Tseng | |
| 6,330,732 | B1 * | 12/2001 | Liu | 15/314 |
| 2003/0037404 | A1 * | 2/2003 | Wu et al. | 15/344 |

FOREIGN PATENT DOCUMENTS

| | | | |
|---|---|---|---|
| CN | 86 2 00138 U | | 1/1987 |
| CN | 2352366 Y | | 12/1999 |
| CN | 2354778 Y | | 12/1999 |
| FR | 2573699 | | 5/1986 |
| GB | 2108434 | | 10/1981 |
| GB | 2076642 | | 12/1981 |
| GB | 2259444 | | 3/1993 |
| JP | 1-258782 | | 10/1989 |
| JP | 6239096 | | 8/1994 |
| JP | 07-309099 | * | 11/1995 |
| JP | 8-116 | | 1/1996 |
| JP | 08-267995 | * | 10/1996 |
| JP | 2000-085297 | * | 3/2000 |
| JP | 2001-039089 | | 2/2001 |
| JP | 2001-039090 | | 2/2001 |

* cited by examiner

*Primary Examiner*—Terrence R. Till
(74) *Attorney, Agent, or Firm*—Mueller and Smith, LPA

(57) ABSTRACT

An apparatus and method for collecting dust is disclosed. Preferably, the dust to be collected is chalk dust. The apparatus includes a housing supporting an eraser head and having a cavity in fluid communication with a suction device. Interposed between the cavity and the suction device is a collection chamber assembly. A matrix of apertures in the front wall are selectively openable and closeable by a controller in response to the orientation of the eraser. When the eraser is moved across a chalkboard to create airborne chalk dust, the apertures are selectively opened by the controller, the suction device urging the airborne chalk dust through the apertures, through the cavity, and into the collection chamber assembly where it is filtered and stored. The method includes the steps of providing the apparatus of the invention, energizing the suction device, and moving the eraser across a chalkboard to collect chalk dust.

20 Claims, 5 Drawing Sheets

ERASER HAVING SELECTIVELY OPENABLE AND CLOSABLE APERATURES

CROSS-REFERENCE TO RELATED APPLICATIONS

This application claims priority based on Chinese Application No. 01 2 29283.4 filed Jun. 29, 2001, the disclosure of which is herein incorporated by reference.

STATEMENT REGARDING FEDERALLY SPONSORED RESEARCH

Not applicable.

BACKGROUND OF THE INVENTION

Many schools provide chalkboards and chalk for teachers to use as educational tools. The teachers write on the blackboards with the chalk and erase the writings with cotton head erasers, causing particles of chalk dust or powder to drift into the air. The floating chalk dust is harmful to health of the teachers and students.

As an alternative to conventional erasers, teachers may use a wet cloth to clear the chalkboard in order to reduce the amount of chalk dust polluting the air. A consequent problem with this method is that the teacher must wait until the board is dry before writing on it again with chalk, which is inconvenient for both teachers and students. In recent years, new ideas in improving chalk to produce less chalk dust have come to light. While somewhat reducing chalk dust, such chalk usually provide lighter writing and make scratching noises when in contact with a chalkboard.

Attention also has been given to erasers with vacuum devices, including motor-driven fans, which act to more efficiently collect dust particles. While these devices represent an advance in the art, improvements to such devices continue to be sought.

BRIEF SUMMARY OF THE INVENTION

The present invention is directed to an eraser for collecting dust, i.e., chalk dust, released from a surface, i.e., a chalkboard. The eraser includes a housing having a front wall to which is attached an eraser head. Extending through the front wall are a matrix of apertures. A controller, consisting in part of a single panel or a series of panels, is provided to selectively open and close the apertures in response to the orientation of the eraser as it contacts the chalkboard. Within the housing is a cavity and a collection chamber assembly. Attached to the eraser housing is a selectively energizeable suction device. When the suction device is energized, the controller selectively opens and closes the apertures and airborne chalk dust is drawn through the open apertures through the cavity and into the collection chamber assembly. Inside the collection chamber assembly the air is filtered, the chalk dust remaining in the collection chamber of the assembly, while filtered air is exhausted by the suction device.

Also disclosed is a method for collecting dust, i.e. chalk dust, released from a surface, i.e., chalkboard. The method includes the steps of providing an eraser such as described above, energizing the suction device, and moving the eraser across a chalkboard to collect chalk dust.

BRIEF DESCRIPTION OF THE DRAWINGS

For a fuller understanding of the nature and advantages of the present invention, reference should be had to the following detailed description taken in connection with the accompanying drawings, in which.

DETAILED DESCRIPTION OF THE INVENTION

Generally, as an eraser is moved across a chalkboard, chalk dust is released into the air, which is deleterious to the health of teachers and students. The present invention addresses the problem of effectively collecting that chalk dust. In operation, the user activates a motor and blower assembly located at the rear of the eraser to create a vacuum within the eraser housing, which causes air to flow from the front of the eraser rearward. Then, the user moves the eraser across a chalk board to release chalk dust into the air. Airborne chalk dust (e.g., particles) is drawn away from the chalk board and directed into the eraser. A controller selectively opens and closes a series or matrix of apertures located around the periphery of the eraser head in response to the orientation of the eraser as it confronts the chalkboard. Advantageously, the controller biases the flow of chalk dust and air mixture toward the apertures located at the bottom of the eraser. Airborne chalk dust passing through the apertures is drawn into a cavity within the eraser where it passes into a collection chamber assembly which filters the air. The chalk dust is retained in the collection chamber assembly for later removal, while the filtered air is directed rearwardly toward the back of the eraser and is expelled through vents in the blower assembly.

Figure 1:
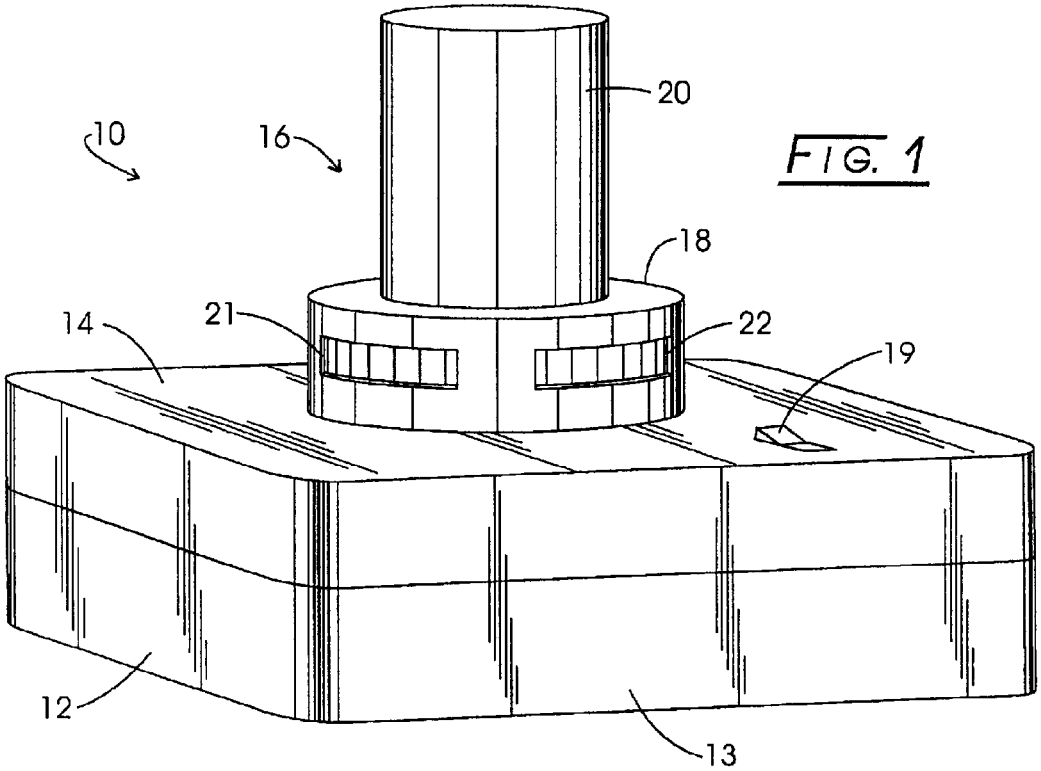
FIG. 1 is a perspective view of one embodiment of the invention.

Referring now to FIG. 1, an eraser incorporating the features of the invention is represented generally at 10. Eraser 10 includes a generally rectangular housing, 12, having a front wall, 30 (FIG. 3), and a rearwall, 14. Extending between front wall 30 and rear wall 14 is sidewall 13. Within housing 12, airborne chalk is filtered and stored. Housing 12 preferably is formed of plastic, which optionally may be reinforced. Alternatively, housing 12 may be formed of fiber board, fiber composite, ceramic, metal, etc. Any of the foregoing materials may be fiber reinforced or laminated in construction. As will be described in greater detail below, apertures through which airborne chalk dust enters the eraser are located in the front wall of the housing (FIG. 3) which contacts the chalkboard. Contained within housing 12 is a collection chamber assembly which filters air and stores collected chalk dust.

Figure 4:
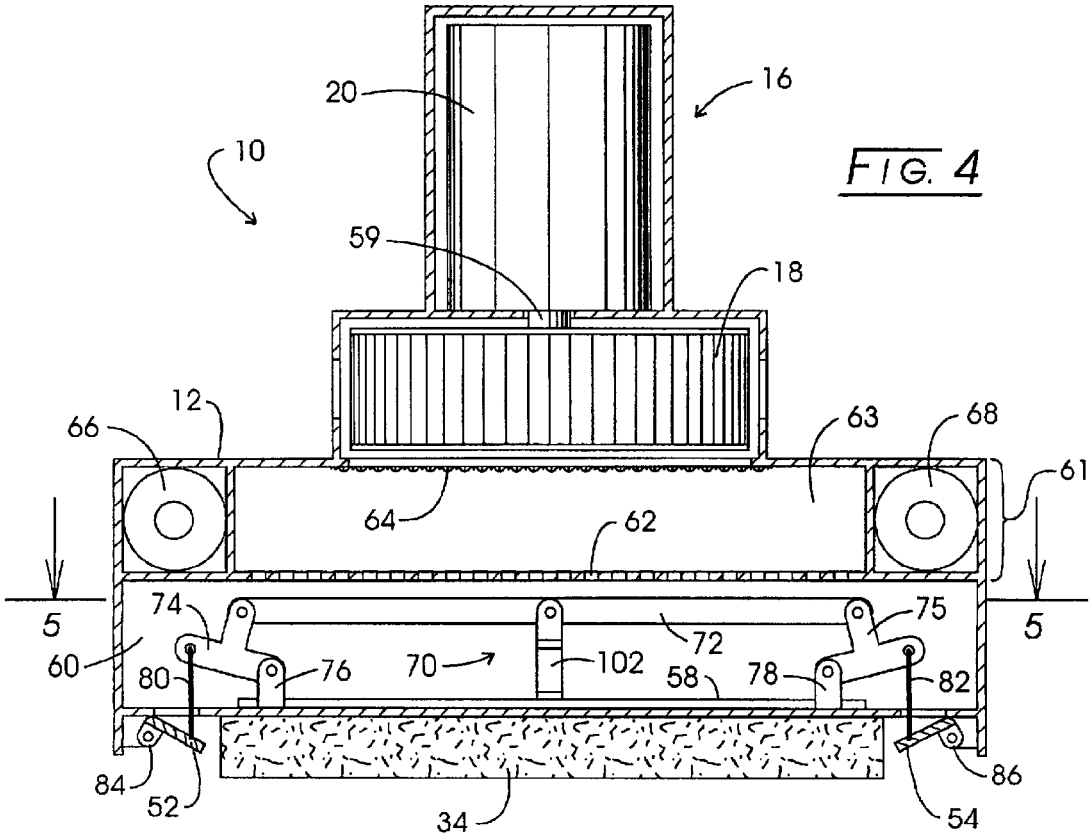
FIG. 4 is a cross sectional view taken through the plane 44 in FIG. 3 showing the eraser in a horizontal orientation.

Connected to rear wall 14 of housing 12 is a selectively energizeable suction device, shown generally at 16. Suction device 16 creates a vacuum within housing 12 which draws airborne chalk through the eraser. Preferably, suction device 16 includes a circular blower assembly, 18, a motor, 20, and a power supply, i.e., two batteries as shown at 66 and 68 in FIG. 4. Blower assembly 18 may include, for example, a squirrel cage blower (as shown) or an axial fan. In conventional fashion, blower assembly 18 includes a plurality of vents for exhausting air. Two such vents are shown at 21 and 22. Motor 20 is connected to the rear of blower assembly 18. A switch, 19, located along the rear wall 14 of housing 12 is provided for selectively energizing motor 20. Motor 20 may be a fractional horsepower DC (e.g., battery powered as shown in FIG. 4) or AC motor (e.g., line powered, not shown). When connected as shown in FIG. 1, blower assembly 18 and motor 20 provide a convenient handle for the user to grasp eraser 10. However, suction device 16 is not limited to this configuration and other configurations may be employed. Also, as an alternative to blower assembly 18 and motor 20, suction device 16 may include a cyclone mechanism with an associated power supply. Cyclone mechanisms capable of use as a suction device are well known to those of ordinary skill in the art.

Figure 2:
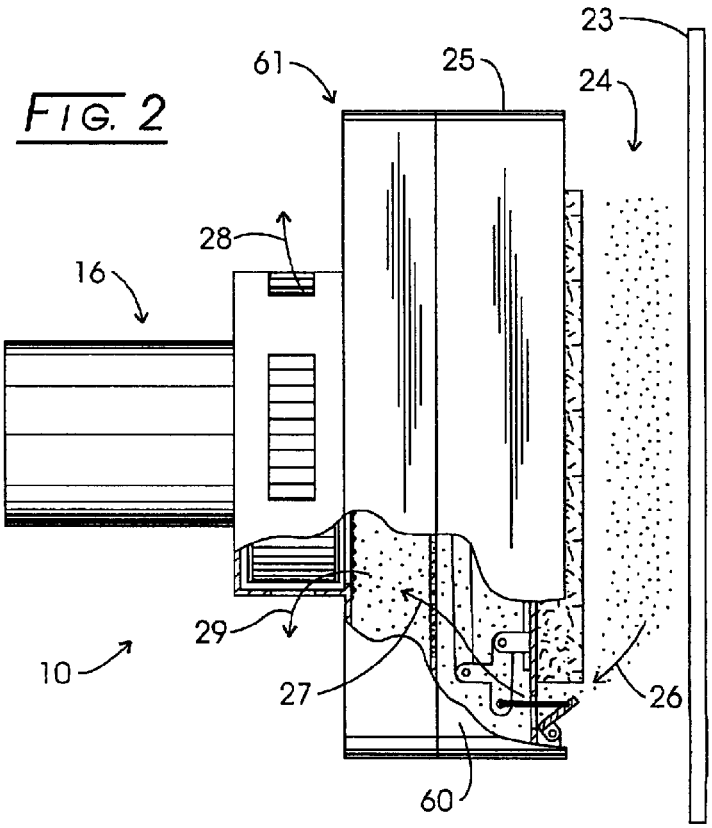
FIG. 2 is a perspective view of the eraser of FIG. 1 spaced apart from a chalkboard.

FIG. 2 shows the flow of air entraining chalk dust resulting from a user erasing a chalkboard. The chalkboard is shown at 23 with eraser 10 in close adjacency thereto. In actual use, eraser 10 would be held flush against the chalkboard. However, for illustrative purposes eraser 10 is shown spaced apart from the chalkboard so that chalk dust can be seen being directed into the eraser. Moving eraser 10 across chalkboard 23 releases chalk dust into the air, the airborne chalk dust being shown generally at 24. Suction device 16 is energized to create a vacuum in housing 12, and airborne chalk dust 24 is drawn into cavity 60 through a matrix of apertures 25, as indicated by arrow 26. Airborne chalk dust 24 then passes into a collection chamber assembly at 61 as indicated by arrow 27. In collection chamber assembly 61 the air is filtered, the chalk dust remaining in the collection chamber for later removal while clean, filtered air passes through collection chamber 61 and into blower assembly 18. The clean air then is exhausted from eraser 10 through vents 21 and 22 as indicated by arrows 28 and 29.

Figure 3:
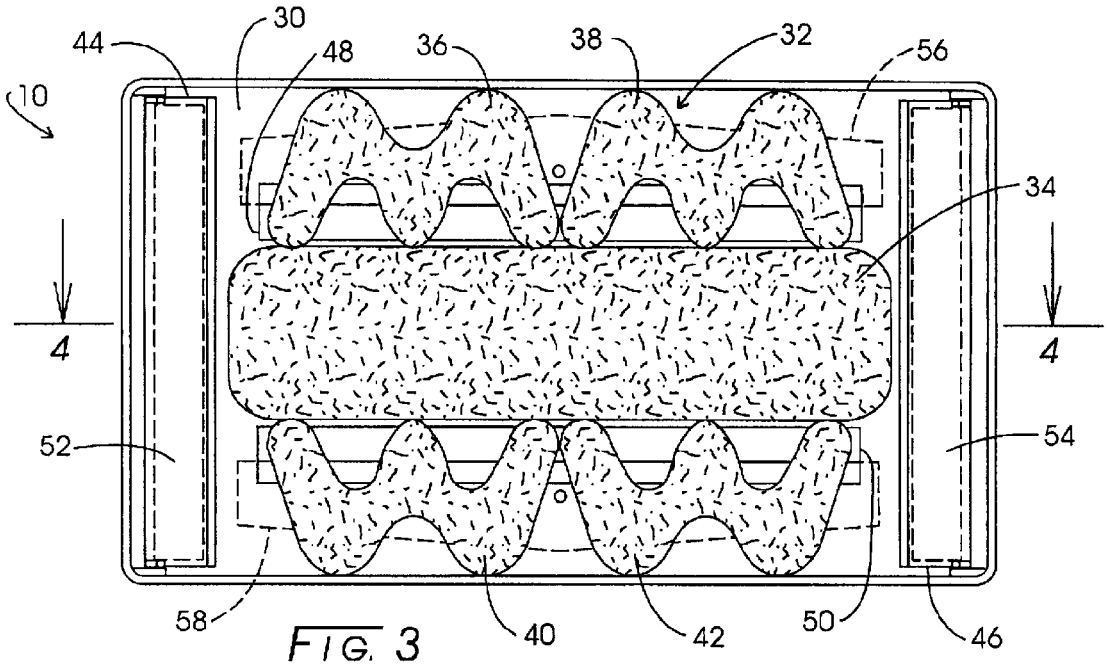
FIG. 3 is a bottom view of the embodiment illustrated in FIG. 1.

FIG. 3 shows a bottom view of eraser 10 including front wall 30 of housing 12. Connected to front wall 30 is an eraser head, shown generally at 32, which contacts the surface of the chalk board. Eraser head 32 includes a generally rectangular-shaped central portion 34, as well as W-shaped portions 36, 38, 40, and 42. Eraser head 32 may be formed of any conventional material, such as laminated felt, cellular latex, wool, cotton, etc., or a combination thereof. These types of materials are effective in releasing chalk dust and because each is of a porous nature, air and some airborne chalk dust will pass therethrough. Eraser head 32 may be removable for cleaning or in order to be replaced when it becomes worn out.

About the periphery of front wall 30 are pairs of rectangular apertures, one pair being shown at 44 and 46, and another pair being shown at 48 and 50. Positioned to selectively open and close these apertures, respectively, are pairs of panels shown in phantom at 52, 54, 56, and 58. When opened, the apertures permit airborne chalk dust to be drawn into housing 12.

FIGS. 4–11 illustrate how the apertures are selectively opened and closed by a controller in response to the orientation of the eraser. FIGS. 4–7 show an embodiment of the invention utilizing a weight system to control the apertures' opening and closing.

Looking to FIG. 4, a cross sectional view of eraser 10 of FIG. 1 is shown. In this view, it may be seen that motor 20 is connected to blower assembly 18 by means of a shaft, 59. For cost, convenience, and safety reasons, all of the components of eraser 10 may be contained within housing 12. Because the eraser may be used by students as well as teachers, enclosing all of the components within the housing provides a beneficial safety feature. No rotatable equipment is exposed, which otherwise might be bent or broken, or cause injury to the user. To make eraser 10 easier to use, a strap may be provided extending across the rearwall of housing 12, through which a user could insert his or her hand. Alternatively, as shown, housing 12 may conform to the shape of suction device 16, with the motor 20 and blower assembly 18 being contained therein. This configuration provides a convenient handle for the user to grasp. By selecting a relatively small motor, the eraser handle may be easily grasped by small children.

Shown within housing 12 is cavity 60. Interposed between cavity 60 and suction device 16 is a rectangular collection chamber assembly 61. Collection chamber assembly 61 includes a forward foramenous lid 62, which allows air entraining chalk dust to pass from cavity 60 into a collection chamber, 63. At the rear of collection chamber 63 is a rearward filter 64. Filter 64 acts to filter chalk dust from the air. The porosity of filter 64 is such that air passes through it while chalk dust remains retained on filter 64 and in collection chamber 63. Collection chamber assembly 61 may be removable so that chalk dust can be emptied from it. While collection chamber assembly 61 is shown in FIG. 4 having a rectangular shape that conforms to the dimensions of housing 12, collection chamber assembly 61 may vary in both size and shape. For example, as shown in FIGS. 7–11, collection chamber 61 may be oval in shape. Collection chamber 61 also may be formed to accommodate other components contained within housing 12. Located on either side of collection chamber 61 are batteries 66 and 68. These batteries are electrically connected to motor 20 and constitute the power supply referred to in connection with FIG. 1. Although batteries 66 and 68 are shown as conventional alkaline batteries, which may be replaced, 66 and 68 also may be Nickel-Cadmium or other rechargeable batteries. Power may be supplied to motor 20 by any conventional means consistent with the invention. For example, instead of batteries, motor 20 may be selectively energizeable by line power for an a.c. motor.

In the embodiment illustrated in FIG. 3, a weight system controls the opening and closing of the eraser's apertures. This weight system is indicated generally at 70 and includes a lever arm weight, 72, which is pivotally connected at either end to two T-shaped rotatable members 74 and 75. Each of rotatable members 74 and 75 also is connected to a pivot support, 76 and 78, respectively. Pivot supports 76 and 78 in turn are connected to front wall 30 of eraser 10 and extend transversely to lever arm weight 72. Finally, rotatable members 74 and 75 are connected to panels 52 and 54 by wires 80 and 82, respectively. Panel 52 is seen to be pivotally connected to front wall 30 at pivot assembly 84. Similarly, panel 54 is pivotally connected to front wall 30 at pivot assembly 86.

Lever arm weigh 72 may be formed of material, such as metal, plastic, wood, etc. Lever arm weight 72 may be formed as a solid. Alternatively, lever arm weight 72 may be formed as a hollow tube which may contain movable weights, i.e., ball bearings, to provide level arm weight 72 with additional momentum as it moves in response to movement of eraser 10.

Figure 5:
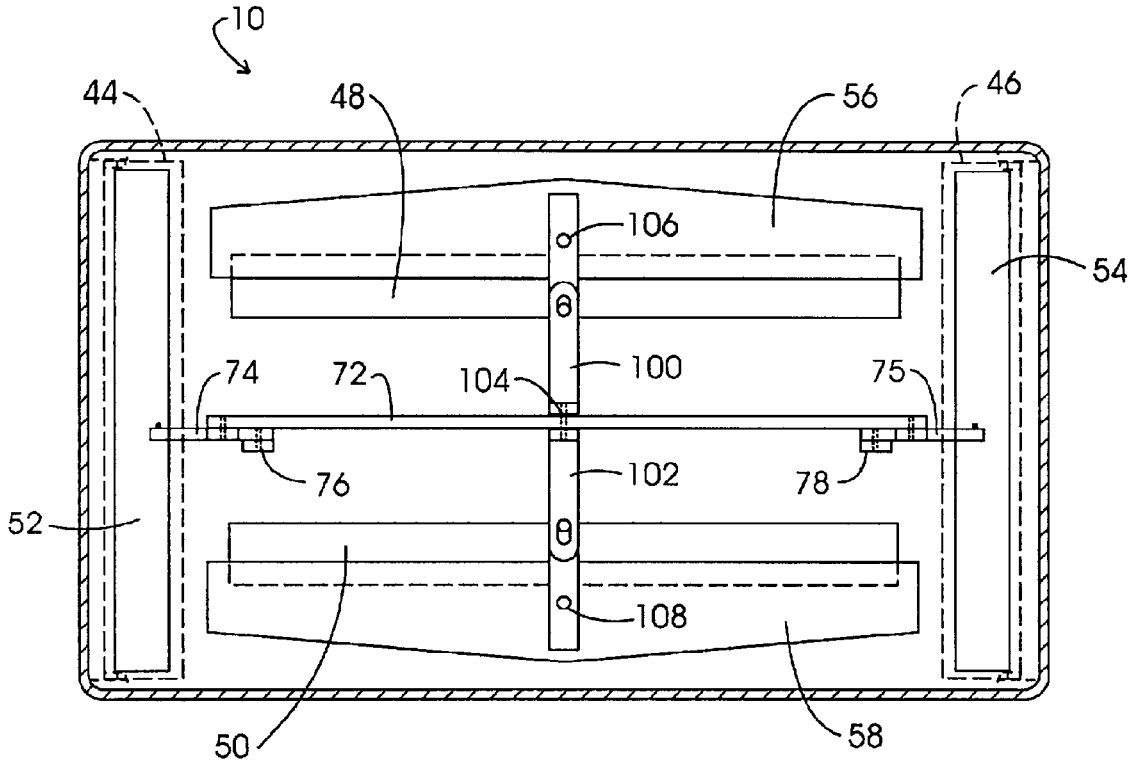
FIG. 5 is a cross sectional view taken through the plane 5—5 in FIG. 4 showing the eraser in a horizontal orientation.

Looking to FIG. 5, weight system components that control panels 56 and 58 are shown. Extending transversely to lever arm weight 72 are two oscillating components, 100 and 102. Oscillating components 100 and 102 are connected to each other and to lever arm weight 72 by a wire, 104. Oscillating component 100 is connected to panel 56 by pivot assembly 106, while oscillating component 102 is connected to panel 58 by pivot assembly 108.

In FIGS. 4 and 5, eraser 10 is shown in a horizontal orientation. In this orientation, lever arm weight 72 is in a central or resting position. When lever arm weight 72 is located in this position, the panels open and close the apertures as shown in FIGS. 4 and 5. Panels 52 and 54 are held in a partly open position as shown in FIG. 4. As shown in FIG. 5, panels 56 and 58 partly cover apertures 48 and 50.

Figure 6:
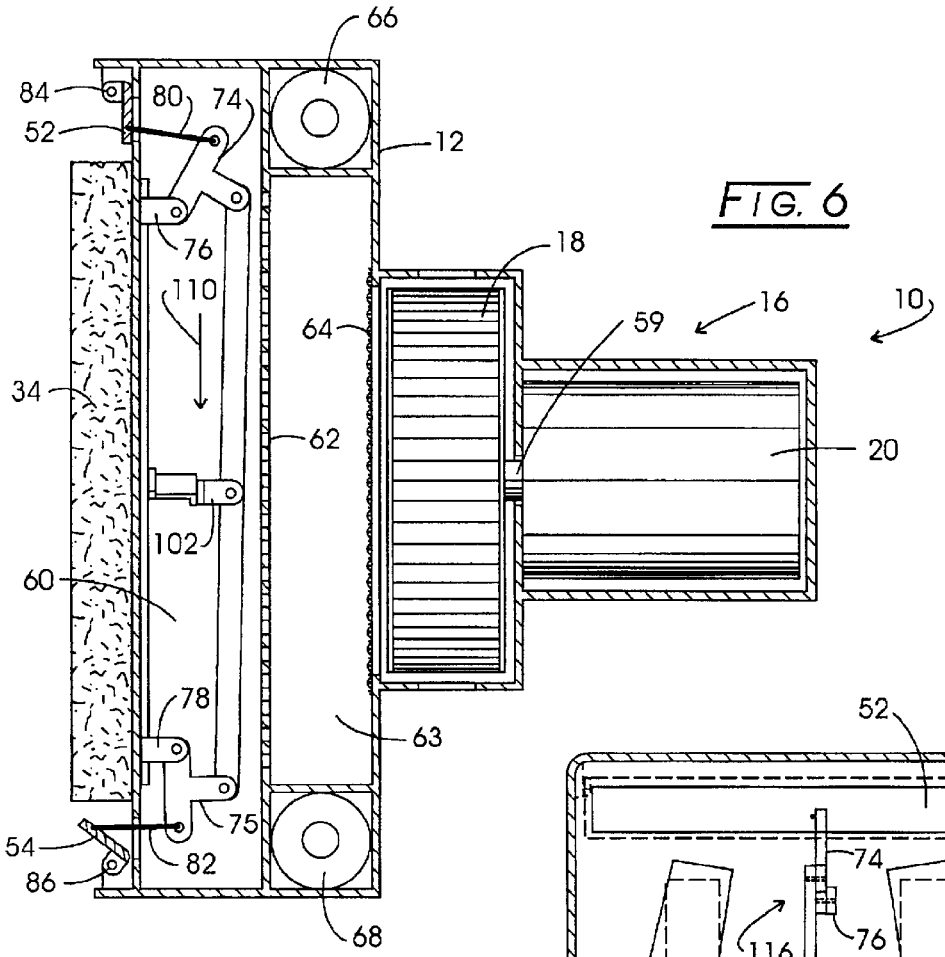
FIG. 6 is a cross sectional view taken through the plane 4—4 in FIG. 3 showing the eraser in a vertical orientation.
Figure 7:
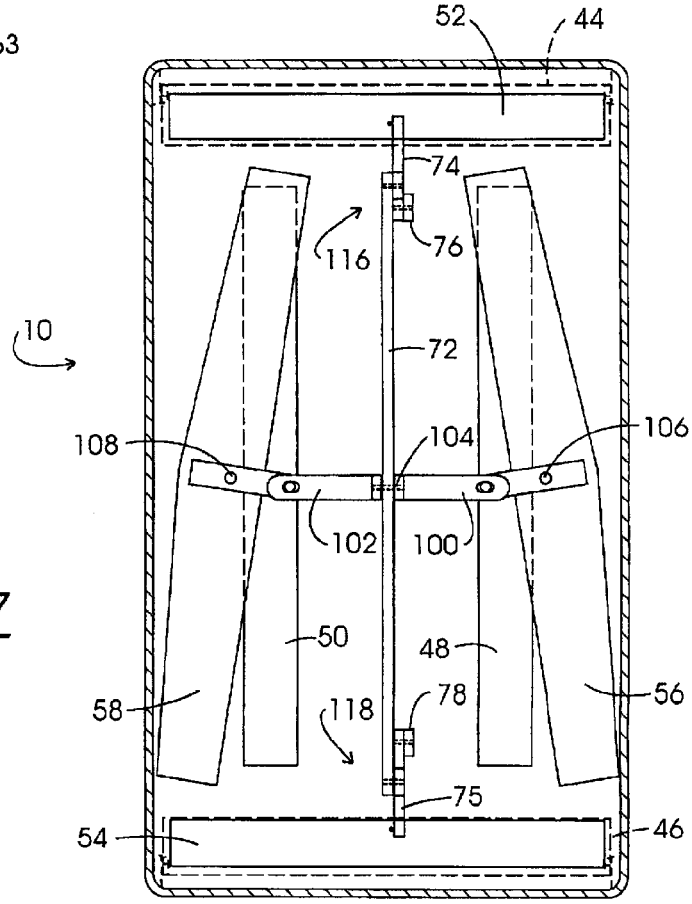
FIG. 7 is a cross sectional view taken through the plane 5—5 in FIG. 4 showing the eraser in a vertical orientation.

Turning now to FIGS. 6 and 7, eraser 10 is shown in a vertical orientation. When eraser 10 is turned to a vertical orientation, lever arm weight 72 falls downward under the force of gravity as indicated by directional arrow 110. This motion of lever arm weight 72 pulls down on rotatable member 74 causing it to rotate in a clockwise direction about its connection to pivot support 76. This clockwise rotation pulls wire 80 inwardly closing panel 84. Advantageously, such closure does not require an airtight seal. The downward motion of lever arm weight 72 also causes rotatable member 75 to rotate in a clockwise direction about its connection to pivot support 78, which slackens wire 82 and further opens panel 54.

FIG. 6 shows the pivoting of panels 56 and 58. As lever arm weight 72 falls downward, wire 104 is drawn downward placing force on oscillating components 100 and 102, which causes panels 56 and 58 to pivot about pivot points 106 and 108, respectively. Included as part of oscillating components 100 and 102 are slots 112 and 114 for arc accommodation. Because wire 104 is drawn downward, the tops of panels 56 and 58 are pivoted inwardly to close the tops of apertures 48 and 50 as shown generally at 116. The bottoms of panels 56 and 58 are pivoted outwardly to open the bottoms of apertures 48 and 50, as shown generally at 118. It can be seen that in this orientation, weight system 70 opens and closes apertures 44, 46, 48, and 50 to provide a configuration wherein the apertures are open toward the bottom of eraser 10 to admit airborne chalk dust and closed at the top such that chalk dust is not admitted. This orientation should be contrasted with the horizontal orientation, in which the apertures are selectively opened and closed such that airborne chalk dust is drawn into cavity 60 all about the periphery of front wall 30.

As can be seen from the above-description, the weight system controls the selective opening and closing of the apertures. This opening and closing includes the situation where the apertures are opened or closed and the situation where the apertures are only partially opened or partially closed. As shown in FIGS. 4–7, panels 52, 54, 56, and 58 are shown to pivot in order to open and close the respective apertures. The weight system also could be modified such that one or more of these panels slideably open and close the apertures.

Another embodiment of the eraser having a different controller is shown in FIGS. 8–11. This second embodiment includes an elliptical-shaped housing having a greater number of small apertures located about its circumference. The controller of this embodiment consists of a single panel with a plurality or matrix of apertures, the alignment of these apertures acting to open and close the front wall apertures.

Figure 8:
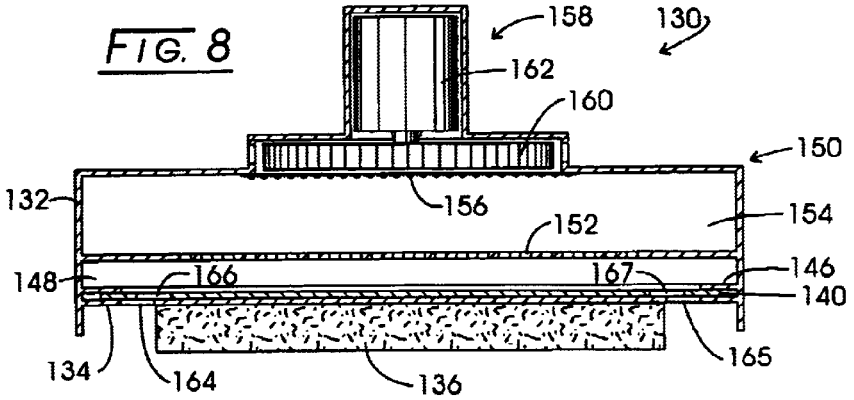
FIG. 8 is a cross sectional view of an alternative embodiment of the invention.
Figure 9:
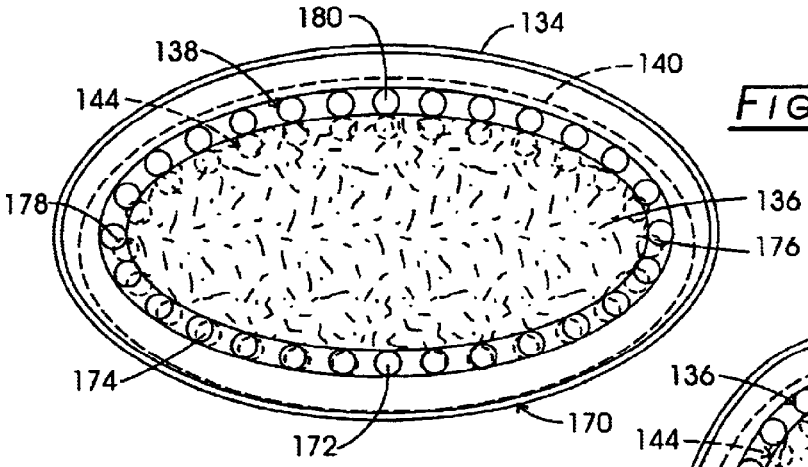
FIG. 9 is a bottom view of the embodiment illustrated in FIG. 8 showing the eraser in a horizontal configuration.

Looking to FIGS. 8 and 9, the eraser, 130, has a generally elliptical shape. Eraser 130 includes a housing, 132, with a front wall, 134. In the center of front wall 134 is an eraser head, 136. Extending through front wall 134 and located about its circumference is a matrix of apertures indicated generally at 138. Two of these apertures are shown at 164 and 165 in FIG. 8.

As in the previously described embodiment, eraser 130 includes a cavity, 148, and a collection chamber assembly, 150. Collection chamber assembly 150 includes a foramenous lid, 152, a collection chamber, 154, and a rearward filter, 156. Connected to the rear of housing 132 is a suction device, 158. Suction device 158 includes a blower assembly, 160, and a motor, 162.

Located behind front wall 134 is a controller, 140, which controls the opening and closing of the apertures of matrix 138. Controller 140 consists of a single, thin, elliptical panel, 142, whose major and minor axes are slightly smaller than those of front wall 134. Controller 140 is shown in phantom in FIGS. 9–11. Controller 140 includes a matrix of apertures, 144, (shown in phantom in FIGS. 9–11) the apertures of which correspond in size and number to those of matrix 138. Two of these apertures are shown at 166 and 167 in FIG. 8. Panel 144 is held in abutment against front wall 134 by a retaining band, 146, projecting from the interior surface of housing 132.

If the centers of front wall 134 and panel 144 were placed in registration, there would be correspondence between the apertures of matrix 138 and matrix 144 except that the apertures of matrix 144 would be disposed inwardly of the apertures of matrix 138. However, because the major and minor axes of panel 144 are slightly smaller than those of front wall 134, as panel 140 moves in relation to front wall 134, the apertures will be opened and closed in response to the orientation of eraser 130.

Figure 10:
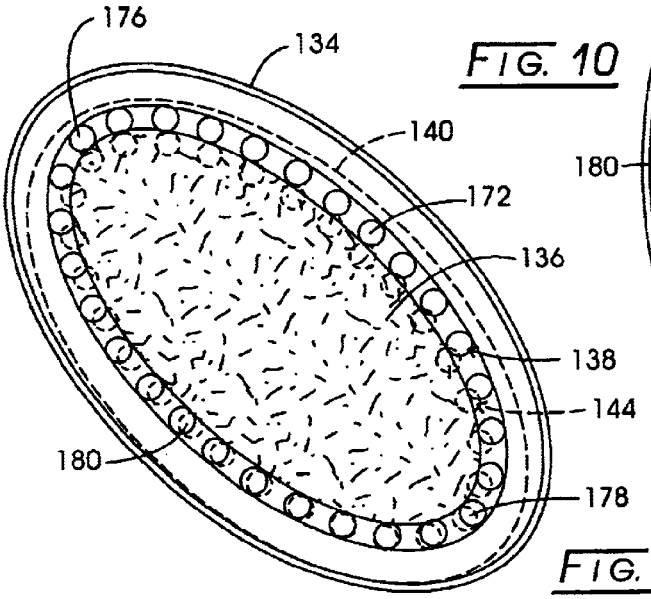
FIG. 10 is a bottom view of the embodiment illustrated in FIG. 8 showing the eraser in a vertical orientation.
Figure 11:
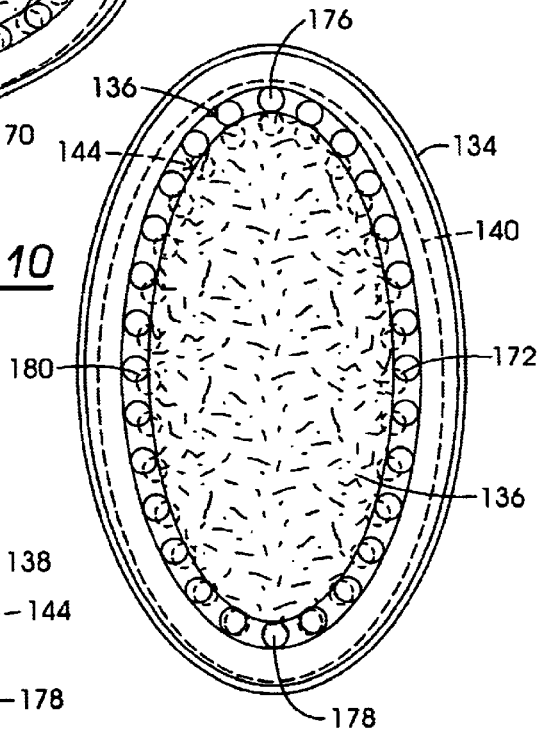
FIG. 11 is a bottom view of the embodiment illustrated in FIG. 8 showing the eraser at a 45° angle.

FIGS. 9–11 illustrate the selective opening and closing of the apertures in response to the orientation of eraser 130. FIG. 9 shows eraser 130 in a horizontal orientation. In this orientation, panel 142 falls under the force of gravity such that its bottom edge rests along the bottom edge of housing 132, as shown generally at 170. In this orientation, one aperture of matrix 138 aligns with one aperture of matrix 144, making that aperture, aperture 172, open. Other apertures of matrix 138 are partially aligned with apertures of matrix 144 causing them to be partially opened, e.g., 174 and 176. Finally, certain apertures of matrix 138 are unaligned with apertures of matrix 144 causing them to be closed, e.g., 178 and 180. As can be seen from this figure, the apertures of panel 144 become increasingly more in coincidence with the apertures of front wall 134 toward the bottom of eraser 130 to provide the advantageous biasing of airflow toward the bottom of eraser 130.

FIG. 10 shows eraser 130 in a vertical orientation. In this orientation, panel 142 falls to the bottom of housing 132 under the force of gravity to align the apertures of matrix 144 with the apertures of matrix 138 as shown. FIG. 11 shows the alignment of the apertures of matrix 144 with the apertures of matrix 138 when eraser 10 is tilted to a 45° angle, i.e., an orientation between horizontal and vertical. As can be seen from FIGS. 9–11, regardless of the orientation of eraser 130, apertures at the bottom of the eraser are opened to a greater degree than those at a higher position vertically.

The embodiments shown in FIGS. 1 and 8 are of rectangular and elliptical configurations, respectively. However, it may easily be seen that other geometries may be utilized. Further, the number and size of apertures and panels also may vary.

While eraser 10 has been described above as being directed primarily to erasing chalk dust from a chalkboard, the present invention is not limited to this use. The eraser may be used on any surface having adherent material that, when removed or dislodged from the surface, forms airborne dust. For example, eraser 10 may be used to collect dust from furniture or dust from a construction site. The design of eraser 10 is sufficiently flexible and adjustable that the eraser may be used effectively on horizontal and vertical surfaces. When used in a vertical orientation, however, the eraser is designed to accommodate the force of gravity acting on the airborne dust.

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application all units are in the metric system and all amounts and percentages are by weight, unless otherwise expressly indicated. Also, all citations referred herein are expressly incorporated herein by reference.

What is claimed is:

1. An eraser for collecting dust released from a surface by said eraser, comprising:

(a) a housing having a front wall with an interior surface and an exterior surface and a back wall, said front and back walls being connected by a sidewall to define a cavity;

(b) an eraser head located along a portion of said exterior surface of said front wall for releasing chalk dust from said surface;

(c) a selectively energizable suction device in fluid communication with said cavity;

(d) a collection chamber assembly interposed between said cavity and said suction device for admitting airborne dust, filtering said dust from air, storing said dust, and expelling filtered air;

(e) a matrix of selectively openable and closable apertures extending through said front wall;

(f) a controller for controlling the opening and closing of said matrix of apertures in response to the orientation of said housing as it confronts said surface, whereby when said eraser is moved across said surface to create airborne dust, said aperture openings are selectively opened by said controller and said suction device urges said airborne dust through said matrix of apertures, through said cavity, and into said collection chamber assembly.

2. The eraser of claim 1 wherein said surface is a horizontal surface.

3. The eraser of claim 1 wherein said surface is a vertical surface.

4. The eraser of claim 3 wherein said vertical surface is a chalkboard and said dust is chalk dust.

5. The eraser of claim 1, further including one or more panels controlled by said controller, which one or more of slidably open and close or pivotally open and close said apertures of said matrix.

6. The eraser of claim 1, wherein said matrix of apertures includes a first set of apertures and a second set of apertures, said first set of apertures being located at a lower position than said second set of apertures and being preferentially closed to a greater extent than said second set of apertures when said eraser is in a vertical orientation.

7. The eraser of claim 1 wherein said housing is formed of plastic.

8. The eraser of claim 1 wherein said eraser head has a given size selected to maximize the amount of chalk erased from a chalkboard.

9. The eraser of claim 1 wherein said suction device comprises:

a selectively energizable motor connected to said cavity;

a power supply connected to said motor; and a blower connected to said motor to create a vacuum when said motor is energized.

10. The eraser of claim 1 wherein said suction device comprises:

a selectively energizable cyclone mechanism connected to said cavity; and a power supply connected to said cyclone mechanism.

11. A method for collecting dust released from a surface, which comprises the steps of:

(a) providing an eraser including, (1) a housing having a front wall with an interior surface and an exterior surface and a back wall, said front and back walls being connected by a sidewall to define a cavity, (2) an eraser head located along a portion of said exterior surface of said front wall for releasing dust from a surface, (4) a selectively energizable suction device in fluid communication with said cavity, (3) a collection chamber assembly interposed between said cavity and said suction device for admitting airborne dust, filtering said dust from air, storing said dust, and expelling filtered air, (4) a matrix of selectively openable and closable apertures extending through said front wall, and (5) a controller for controlling the opening and closing of said matrix of apertures in response to the orientation of said housing as it confronts said surface;

(c) energizing said suction device; and (d) moving said eraser across said surface to release said dust therefrom, so that said suction device urges said dust through said matrix of apertures, through said cavity, and into said collection chamber assembly.

12. The method of claim 11 wherein said surface said eraser is moved across is a chalkboard and said dust released is chalk dust.

13. The method of claim 12 wherein said eraser is provided further including one or more panels controlled by said controller, which one or more of slidably open and close or pivotally open and close said apertures of said matrix.

14. The method of claim 12 wherein said eraser is provided with said matrix of apertures including a first set of apertures and a second set of apertures, said first set of apertures being located at a lower position than said second set of apertures and being preferentially closed to a greater extent than said second set of apertures when said eraser is in a vertical orientation.

15. The method of claim 11 wherein said eraser is provided with said suction device comprising:

a selectively energizable motor connected to said cavity;

a power supply connected to said motor; and a blower connected to said motor to create a vacuum when said motor is energized.

16. An eraser for collecting chalk dust, comprising:

(a) a housing having a front wall with an exterior surface and a back wall, said front and back walls being connected by a sidewall to define an cavity;

(b) an eraser head located along a portion of said exterior surface of said front wall for erasing chalk from a chalkboard;

(c) a selectively energizable suction device in fluid communication with said cavity;

(d) a collection chamber assembly interposed between said cavity and said suction device for admitting airborne chalk dust, filtering said chalk dust from air, storing said chalk dust, and expelling filtered air;

(e) a first set of apertures and a second set of apertures, each aperture of said first and second sets extending through said front wall;

(f) a first set of panels and a second set of panels, each mechanically connected to a weight system for selectively opening and closing said first and second sets of apertures, respectively.

17. The eraser of claim 16, wherein said suction device comprises:

a selectively energizable motor connected to said cavity;

a power supply located within said cavity and electrically connected to said motor; and a blower located within said cavity and connected to said motor to create a vacuum when said motor is energized.

18. The eraser of claim 17 wherein said back wall of said housing conforms to the shape of said motor and said blower to provide a hand graspable portion.

19. The eraser of claim 16 wherein:

said first set of panels includes a first panel and a second panel; and said weight system comprises, a lever arm weight extending between a first end and a second end, said lever arm weight being freely movable such that it falls downward under the force of gravity when said housing is in a vertical orientation, a weight support located between said first and second ends for supporting said lever arm weight, a first pivot support and a second pivot support, a first rotatable member connected to said first end of said lever arm weight, said first pivot support, and said first panel, and a second rotatable member connected to said second end of said lever arm weight, said second pivot support, and said second panel whereby when said lever arm weight falls under the force of gravity, said first rotatable member rotates about said first pivot support to close said first panel and said second rotatable member rotates about said second pivot support to open said second panel.

20. The eraser of claim 19 wherein:

said second set of panels includes a third panel and a fourth panel; and said weight support extends transversely with respect to said lever arm weight and has a first segment and a second segment, said first and second segments being pivotally connected to said third and fourth panels at first and second pivot points, respectively, such that when said lever arm weight falls downward under the force of gravity, said third and fourth panels pivot about said first and second pivot points to partially open said second set of apertures.

* * * * *